US005474256A

United States Patent [19]

Garner

[11] Patent Number: 5,474,256

[45] Date of Patent: Dec. 12, 1995

[54] COMBUSTIBLE FIN PROTECTION DEVICE

[75] Inventor: James M. Garner, Aberdeen, Md.

[73] Assignee: The United States of American as represented by the Secretary of the Army, Washington, D.C.

[21] Appl. No.: 303,782

[22] Filed: Sep. 8, 1994

[51] Int. Cl.[6] ..... F42B 10/04

[52] U.S. Cl. ..... 244/3.24

[58] Field of Search ..... 102/443, 520, 102/522, 523, 521; 244/3.24, 3.25, 3.26

[56] References Cited

U.S. PATENT DOCUMENTS

| | | | |
|---|---|---|---|
| 4,015,527 | 4/1977 | Evans | 102/38 |
| 4,823,699 | 4/1989 | Farinacci | 102/443 |
| 4,838,168 | 6/1989 | Manion et al. | 102/522 |
| 4,936,219 | 6/1990 | Mudd | 102/520 |
| 5,112,008 | 5/1992 | Pahnke et al. | 244/3.24 |
| 5,155,295 | 10/1992 | Campoli | 102/430 |
| 5,160,804 | 11/1992 | Wahner et al. | 102/443 |

FOREIGN PATENT DOCUMENTS

| | | | |
|---|---|---|---|
| 0484958 | 5/1992 | European Pat. Off. | F42B 10/06 |

*Primary Examiner*—Stephen C. Bentley
*Assistant Examiner*—Christopher K. Montgomery
*Attorney, Agent, or Firm*—Freda L. Krosnick; Muzio B. Roberto

[57] ABSTRACT

A combustible fin protection device (10) for protecting the fin planforms (101) on a finned projectile (100) wherein the device (10) comprises a cover member (20) fabricated from a combustible material (21) and dimensioned to envelop the fin planform (101) to protect the fin planform (101) from elevated temperatures and propellant grain impacts during the in-bore transit of the projectile.

4 Claims, 1 Drawing Sheet

COMBUSTIBLE FIN PROTECTION DEVICE

TECHNICAL FIELD

The present invention relates to the field of fin stabilized projectiles in general, and in particular to a combustible device to protect the fins of a projectile.

BACKGROUND ART

As can be seen by reference to the following U.S. Pat. Nos. 5,112,008; 4,823,699; 4,936,219; and 5,160,804; the prior art is replete with myriad and diverse protective measures to minimize the aerodynamic instability of a finned projectile due to damaged fin surfaces.

While all of the aforementioned prior art constructions are more than adequate for the basic purpose and function for which they have been specifically designed, these patented measures are extremely costly to incorporate into the mass manufacture of the finned projectiles.

In-bore fin damage presents a significant problem to the effectiveness of ordnance commonly inducing high yaws or projectile deformation. The principle sources of damage are the high temperature environment and propellant grain impacts to which the fins are subjected to; and, in order to maximize projectile performance it is necessary to minimize projectile fin damage.

As a consequence of the foregoing situation, there has existed a longstanding need for a relatively inexpensive procedure that will effectively protect the finned surfaces of a projectile during its in-bore transit; wherein, the protective measures are consumed within the bore such that a clean projectile exits the bore; and, the provision of such a construction is a stated objective of the present invention.

DISCLOSURE OF THE INVENTION

Briefly stated, the present invention comprises a combustible fin cover or sleeve which will substantially shield the fin from the harsh in-bore environment while not affecting the out-of-bore aerodynamic performance of the projectile.

In addition, the combustible fin covers are also compatible with the propellant and cartridge case to eliminate the risk of accidental ignition and further provided with means to promote the complete consumption of the combustible cover during its in-bore transit.

As will be explained in greater detail in the specification, combustible fin covers have the best features of the mechanical and coating methods of fin protection. The combustible fin covers are designed such that they completely cover the fin and shield it physically, from propellant grain impacts, and thermally from high temperatures in-bore. The combustible fin covers are designed to be consumed by the end of the launch process and the projectile suffers no loss in aerodynamic performance. Ideally, with the combustible fin covers, the fins are exposed only to the aerodynamic heat load.

Combustible fin covers offer the advantages of mechanical devices without such drawbacks as cartridge case intrusion, and increased weight. The primary benefit of the mechanical devices is the potentially excellent thermal and physical protection they offer in-bore. The combustible fin covers offer these same attributes, but the cartridge case volume they occupy, and their weight, would be minimal. Since the combustible fin covers are consumed during launch they create no discard effects! The advantages that combustible fin covers have over noncombustible coatings are primarily ease of application and expense. Since the combustible fin covers are designed to burn away, their adherence to the fin is only required while the projectile is in the bore. Since the combustible fin covers, or combustible coatings, are completely consumed the minimum fin thickness is left, resulting in the best aerodynamic drag characteristics.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
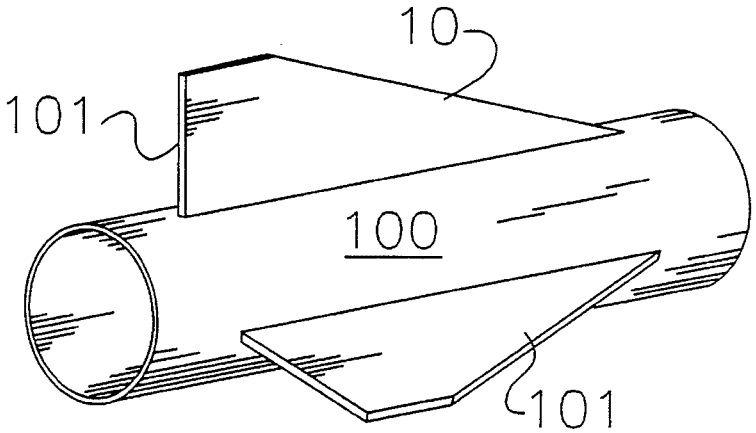
FIG. 1 is a perspective view of a finned projectile equipped with the combustible fin cover that forms the basis of the present invention.

As can be seen by reference to the drawings, and in particular to FIG. 1, the combustible fin protection device that forms the basis of the present invention is designated generally by the reference numeral (10), and is designed to offer thermal protection to the fins (101) of a projectile (100).

Figure 3:
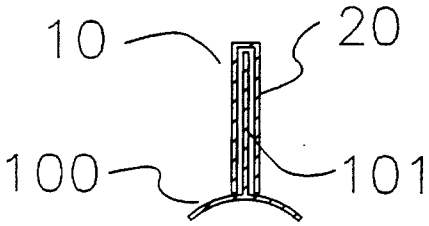
FIG. 3 is a cross-sectional view taken through line 3—3 of FIG. 2.
Figure 2:
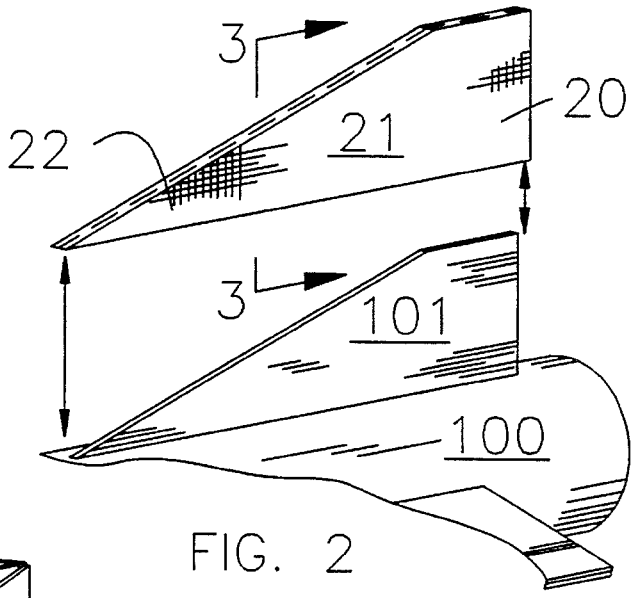
FIG. 2 is an exploded perspective view of the fin cover and fin.

As can best be appreciated by reference to FIGS. 2 and 3 the device (10) comprises a cover or sleeve member (20) which is designed and configured to envelope all of the exposed surfaces on each individual fin planform (101) on a projectile (100). In addition the cover member (20) is fabricated from a combustible material (21) such as a modified nitro-cellulose based material or the like and further given a textured surface (22) to enhance the combustible degradation and consumption of the cover member (20) during its in-bore transit.

Still referring to FIG. 2 it can be seen that the combustible cover member (20) is pre-formed and dimensioned to slip over each fin and be frictionally engaged thereto during the assembly of the ordnance thereby lending itself to relatively inexpensive mass manufacturing techniques which translates into significant savings over the conventional coating and hardening techniques which are time consuming, labor intensive and expensive.

The operation of the combustible fin cover member 20 is quite simple. The fin platform (101) is enveloped by combustible cover member (20) and typically resides in the cartridge case prior to launch. Once the propellant bed ignites, the outer surface (22) of the combustible cover member (20) begins to burn. As the projectile moves forward through the propellant bed the fins (101) are shielded by the burning cover member (20) from the impact of unburned propellant grains, and the extreme heat in the gun chamber. The combustible cover member (20) continues to burn as it progresses down the bore. Due to the large thermal gradient across the combustible cover member (20) thickness, the fin remains cooler during this time. The burning rate and thickness of the cover members (20) are such that as the projectile fins (101) reach the muzzle the combustible cover member is consumed entirely. Ideally combustible cover member (20) will allow projectile fins (101) to avoid in-bore heating and grain impact damage.

Certainly several factors are critical to the successful operation of the combustible covers. The prime question is how to tailor the thickness and burning rate of the covers such that the cover is consumed upon gun exit. The cover member (20) preferably will be made of a propellant-like material. The burning rate of propellant materials is relatively well known under the high chamber pressures encountered in a ballistic environment. The cover member (20) burning rate will further be affected by the cover geometry. The geometry's most important variable is the thickness of the cover member required to protect the fin versus the cover thickness desired for complete combustion. A thickness number can be calculated but presumably the final versions of the cover geometry will be based on empirical burn data. In addition, additives may be put into the propellant-like cover material (20) to further tailor it for strength or burn rate.

As mentioned previously in the preferred embodiment of the invention the combustible fin cover members will be fabricated in the shape of a fin with a slot such that the cover members fit over the fin planforms (101) like a glove. Thus glove would burn away during the launch cycle and be consumed by the time the projectile exits the muzzle.

Figure 5:
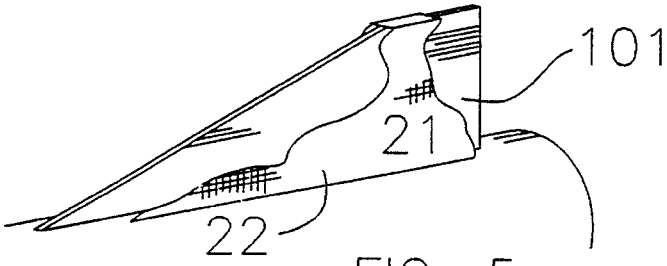

Furthermore, to ensure that the cover member (20) separates even if it is not totally consumed slight indentations and/or perforations (22) may be placed on the cover member (20) in a predetermined pattern to encourage glove degradation and combustion as the projectile nears the muzzle as depicted in FIG. 5.

Figure 4:
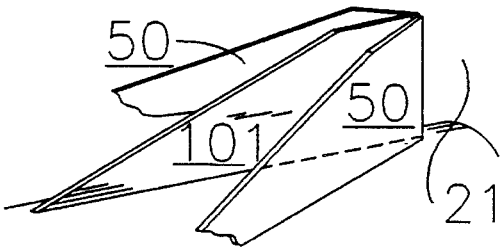
FIG. 4 is a detail view of mechanical means employed to strip the unconsumed remnants of the fin cover from the fin as the projectile exists the bore; and, FIG. 5 is an isolated detail view illustrating the progressive consumption of the fin cover during in bore transit.

In the event that the cover member (20) is not completely consumed during the launch process, this invention further contemplates the provision of mechanical stripper fingers designated as (50) in FIG. 4, that will forcibly remove remnants of the cover member (20) which still adhere to the fin platform (101) prior to the muzzle exit.

In an alternate version of the preferred embodiment the cover member (20) is fabricated by dipping the fin planforms in a supersaturated propellant solution; wherein, the thickness of the cover member (20) would be controlled by the number of dippings Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A combustible fin protection device for an ordnance projectile equipped with fin planforms, the improvement therein comprising:

prefabricated, combustible, fin cover members provided with a slot dimensioned to receive, envelop and frictionally adhere to the fin planforms.

2. The device as in claim 1; wherein the exterior surface of a cover member is textured to promote thermal degradation of the combustible material.

3. The device as in claim 1 wherein, the combustible fin cover members comprise a nitro-cellulose based material formed from a liquid medium.

4. The device as in claim 3; wherein, a cover member is formed on the fin planform by dipping the fin planform into a liquid medium.

* * * * *